US006598688B2

(12) United States Patent
Wang

(10) Patent No.: US 6,598,688 B2
(45) Date of Patent: Jul. 29, 2003

(54) DRILL STEEL FOR DRILLING MINE ROOFS AND ASSOCIATED METHOD OF DRILLING BORES

(76) Inventor: John Wang, Great Industries, Inc., 342 Trinity La., Oak Brook, IL (US) 60523

( * ) Notice: Subject to any disclaimer, the term of this patent is extended or adjusted under 35 U.S.C. 154(b) by 0 days.

(21) Appl. No.: 09/906,335

(22) Filed: Jul. 16, 2001

(65) Prior Publication Data

US 2003/0010539 A1 Jan. 16, 2003

(51) Int. Cl.[7] ..... F21B 17/04; F16B 7/00

(52) U.S. Cl. ..... 175/320; 403/292; 403/300; 403/383

(58) Field of Search ..... 175/320; 403/292, 403/383, 300

(56) References Cited

U.S. PATENT DOCUMENTS

| | | | | |
|---|---|---|---|---|
| 2,733,943 A | | 2/1956 | Nater | |
| 3,178,210 A | * | 4/1965 | Dickinson | 175/323 |
| 3,187,825 A | | 6/1965 | Bower, Jr. | |
| 3,360,285 A | * | 12/1967 | Huckshold | 279/28 |
| 3,554,306 A | | 1/1971 | Wilburn | |
| 4,009,760 A | | 3/1977 | Hansen et al. | |
| 4,099,585 A | * | 7/1978 | Emmerich | 175/320 |
| 4,226,290 A | | 10/1980 | McSweeney | |
| 4,558,976 A | * | 12/1985 | Begluitti | 175/300 |
| 4,702,328 A | | 10/1987 | McSweeney et al. | |
| 4,749,051 A | | 6/1988 | Larsson | |
| 4,773,490 A | | 9/1988 | McSweeney et al. | |
| 6,189,632 B1 | | 2/2001 | Warden | |

* cited by examiner

*Primary Examiner*—David Bagnell
*Assistant Examiner*—Shane Bomar
(74) *Attorney, Agent, or Firm*—Polit & Erickson LLC

(57) ABSTRACT

A drill member, or "drill steel," is used in a drilling system for installing roof bolts in a mine. The drill member comprises an elongated bar having a central through bore and opposite open ends. The bar has a cross section that defines a circular outside perimeter and a polygonal inside perimeter. The polygonal inside perimeter is configured for coupling of the drill steel to drill bits at one end and to a motorized drill driving device at an opposite end.

16 Claims, 11 Drawing Sheets

DRILL STEEL FOR DRILLING MINE ROOFS AND ASSOCIATED METHOD OF DRILLING BORES

TECHNICAL FIELD OF THE INVENTION

The invention relates to drill steel members for a roof drilling system used in mines.

BACKGROUND OF THE INVENTION

In the mining industry, it is known to support the roof of the mine by drilling vertical holes in the overhead rock strata, and then installing roof bolts into the newly drilled holes. The roof bolts are generally installed into the drilled holes with an adhesive to further secure the bolts within the drilled holes. The bolts secure a metal plate that is positioned to support the rock strata to prevent collapse of the mine roof.

To drill holes in the rock strata, a roof drilling machine is utilized. The drilling machines include a drill driving device and drill steel members. A carbide bit is attached to one end of the final drill steel member, to drill the holes in the mine roof. These drill steel members are generally coupled on the other end to the drill driving device by a chuck located on the drilling machine. This driving device rotates the drill steel member, and thus the drill bit, to remove material and debris from the drilled hole. Many drilling machines incorporate a vacuum suction collection system wherein the drill steel member is a hollow steel bar having a central passage, and the drill bit includes a passageway open to the central passage. The vacuum system collects the debris as it is passed through the bit passageway and the central passage during drilling of the rock strata.

In elevated height mines, the drill steel members are provided with a sufficient length for drilling the desired seam, without the need to replace or extend the drill steel member. In low height mines the hole is initially drilled with a shorter drill steel member, often known as a starter, and then the starter is replaced with additional sections of drill steel, such as drivers, extensions and finishers, to drill the remaining depth of the hole. The additional sections are joined together by component parts that include, for example, a drill bit seat, male and female connectors, and a drive end component. The components are attached or configured to connect to the ends of the drill steel members or sections.

According to one system, a drill steel section is cut to the desired drilling length for a particular member and then the ends of the section are beveled and then component parts are welded onto the corresponding ends of the drill steel section. Many drawbacks for this manufacturing method exist. Welding components and drill sections can induce stress fractures and misalignments.

Other methods have been developed. U.S. Pat. No. 3,554,306 discloses a vacuum drill rod system utilizing tubular members. The tubular members have hexagonal inner and outer cross sectional perimeters which interact with comparable outer and inner cross sectional perimeters of cooperating elements when the rod system is connected to achieve concurrent rotation of the elements of the system. However, this system suffers the drawback that the drill steel rods have hexagonal cross sections that are rotated within the drilled hole. Such rods have been known to cause excessive sound levels within the mine due to the rattling or impact of the hexagonal surface of the drill steel against the round drilled hole.

U.S. Pat. No. 6,189,632 discloses a drilling system utilizing round, hollow drill steel members interconnectable by short components. The short components include a male component machined onto an end of the drill steel member and a corresponding female coupling. The male component comprises an extension with a cross-section defining an external hexagonal perimeter, and the corresponding female coupling element has a cross-section defining an internal hexagonal perimeter, the female component press fit onto the male component. One drawback of this described system is that the drill steel member must be precisely machined to length and must have the aforementioned machined end.

The present inventor has recognized the desirability of providing a drilling system for drilling holes for mine roof bolts which does not require undue machining of the drill steel, which does not require the drill steel to be cut to predetermined lengths and which does not produce excessive noise.

SUMMARY OF THE INVENTION

The invention provides an improved drill member, or "drill steel," for use in a drilling system for installing roof bolts in a mine. The invention provides an improved drilling system incorporating the drill member. The drill member comprises an elongated bar having a central through bore and opposite open ends. The bar has a cross section that defines a circular outside perimeter and a polygonal inside perimeter. The polygonal inside perimeter allows for convenient coupling of the drill member to drill bits at one end and to a motorized drill driving device at an opposite end. The polygonal inside perimeter allows for coupling of the drill members to other drill members using couplings.

The drill members can be cut to any length and the cut open end can accommodate components or interposed couplings without the need for machining a specialized coupling element or configuration onto the member. Additionally, the round outside perimeter allows the drill steel to be more quietly rotated within the drilled hole.

In order to couple the drill steel to the motorized drill driving device, a base assembly is used. The base assembly includes a stub member and a base member. The base member includes a bottom fixture having a cross section defining a polygonal outside perimeter for being received into a correspondingly shaped socket or chuck of the motorized drill driving device. The base member includes a socket having a polygonal inside perimeter. The base member also includes a collar for receiving axial force from the drill driving device.

The stub member includes a bottom fixture having a cross section defining a polygonal outside perimeter that is received into the socket formed in the base member. The stub member further includes a flange that is supported on an internal shoulder within the socket of the base member. In this way, the axial force exerted on the base member by the drill driving device is transferred to the flange of the stub member. The stub member further includes a stub shaft extending upwardly from the flange and having a cross section defining an outside polygonal perimeter, sized and shaped to snugly fit within the open end of the drill member. The socket of the base member is sized such that the drill member fits over the stub shaft and is partially recessed into the socket to press against a top side of the flange of the stub member. In this way, the axial thrust from the base member to the flange is transferred to the end face of the drill member.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
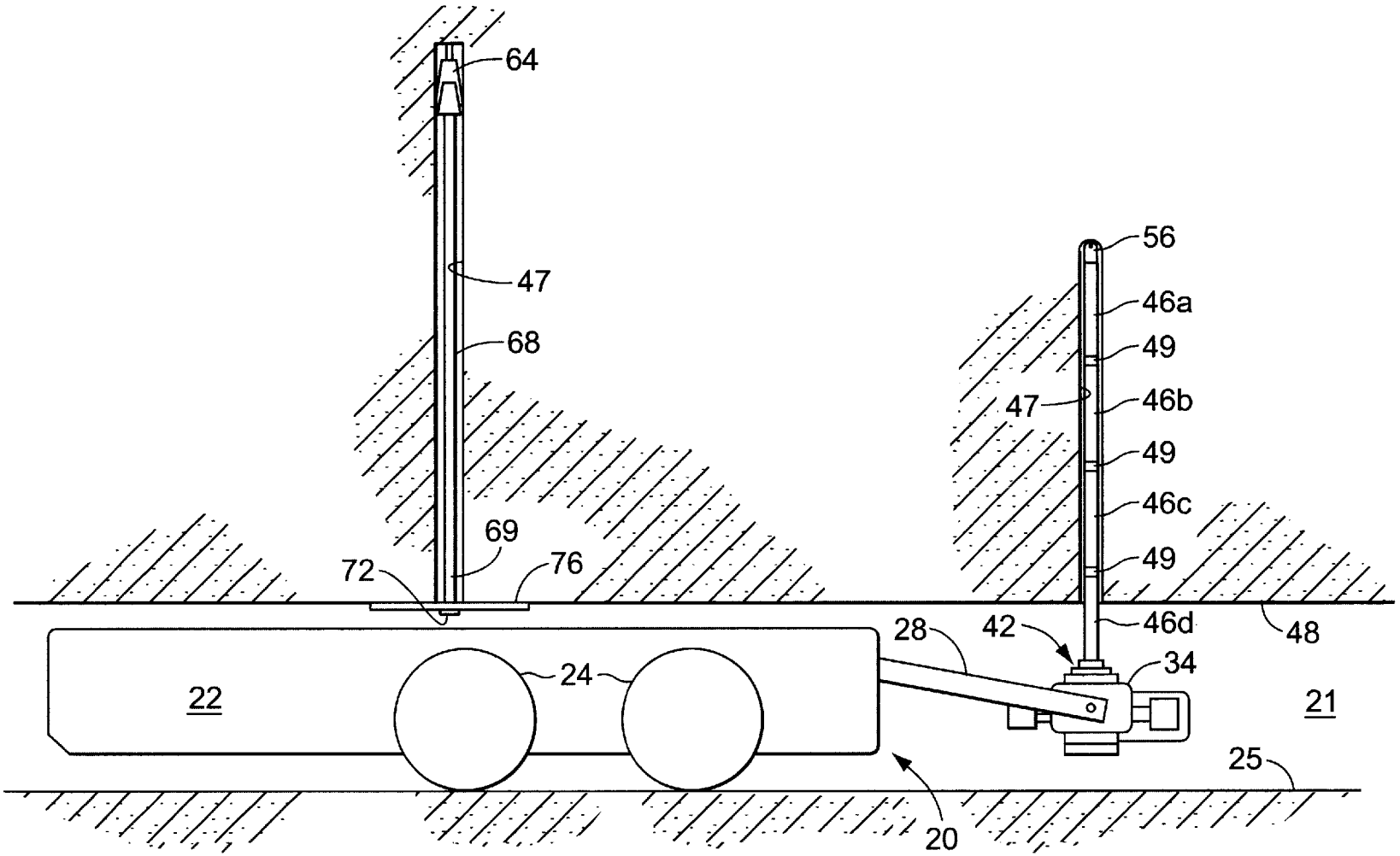
FIG. 1 is a diagrammatic view of a drill system of the present invention, in use in a line.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a roof drilling machine 20. The machine 20 is designed to operate within low seams 21, such as seams of coal. The drilling machine includes a chassis 22 that is supported on wheels 24 from the mine floor 25. Articulated boom components 28 support drill heads 34.

A base assembly 42 is fit onto, and into, the drill head 34. The base assembly 42 is used to couple a lowest drill member 46*d* to the motorized drill driving device 34. A drill bit 56 is fixed to an end of the highest drill member 46*a* via a bit seat 59. Drill members 46*a*, 46*b*, 46*c* extend from the lowest drill member 46*d* into the drilled hole 47 into the roof 48.

The hole 47 is initially started by the drill member 46*a* extending from the base 42, and the drill members 46*b*, 46*c*, 46*d* are progressively added, as needed, as the bit 56 progresses into the rock. The drill members 46*a*, 46*b*, 46*c*, 46*d* are connected by interposed connectors or couplings 49, shown in detail in FIGS. 5E and 5F.

Once the hole 47 is drilled, an anchor 64 mounted on a shank 68, is inserted into the hole 47 and a threaded end 69 of the shank receives a nut 72. The nut 72 is tightened to secure a roof plate 76 against the roof 48.

Figure 2A:
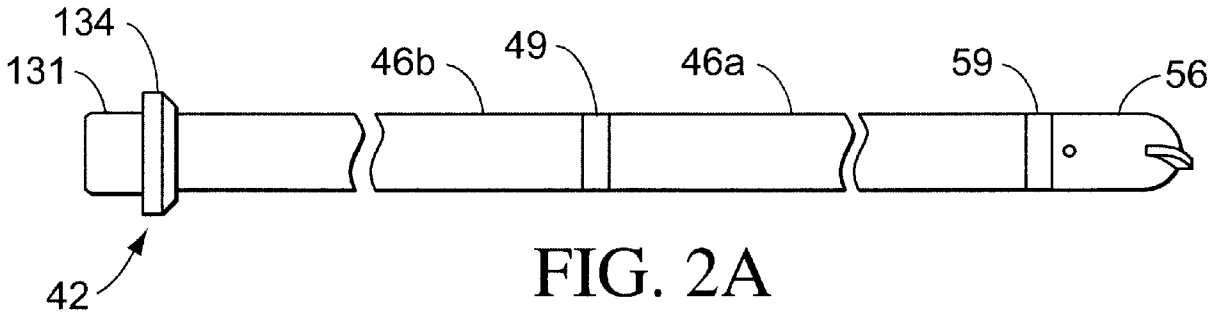
FIG. 2A is an enlarged plan view of the drill components of the drill system of FIG. 1.
Figure 2B:
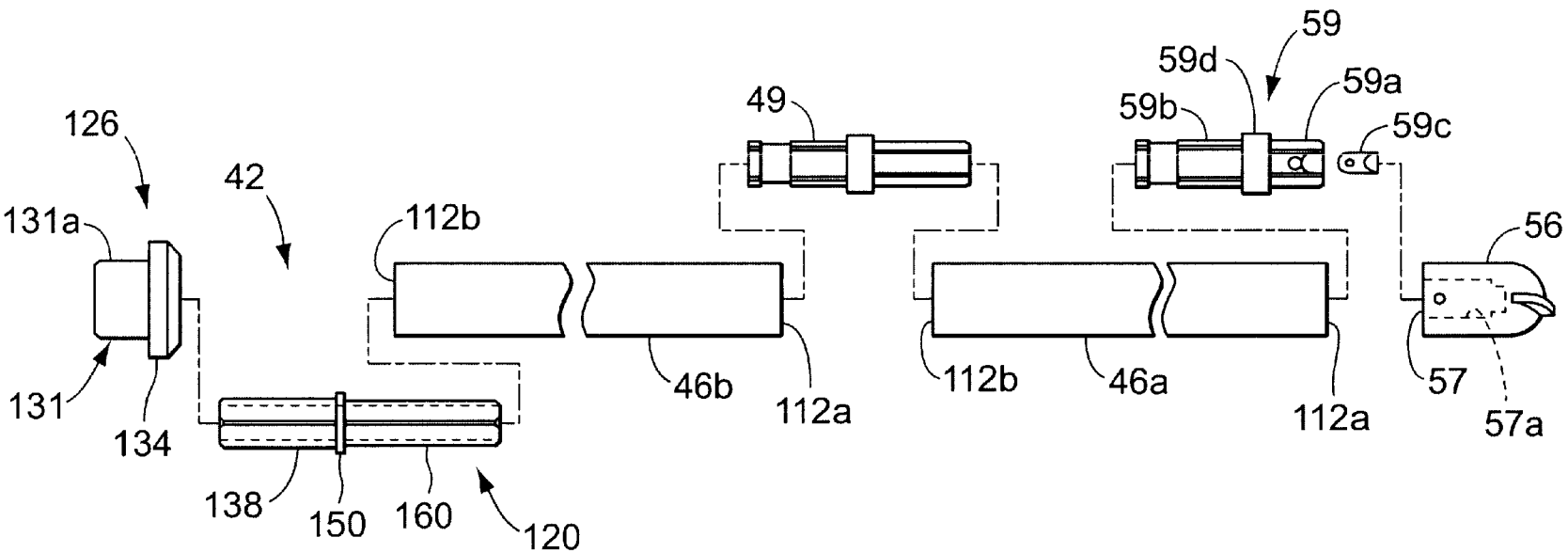
FIG. 2B is an exploded view of the drill components of FIG. 2A.
Figure 3A:
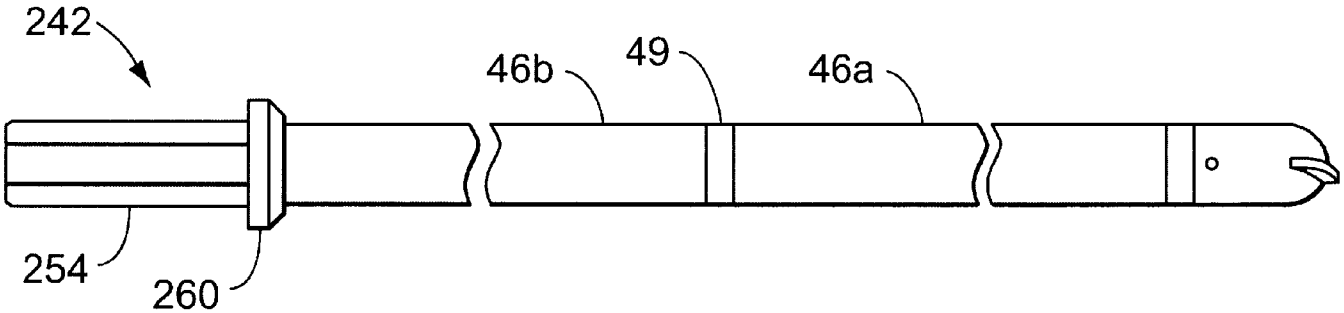
FIG. 3A is an enlarged plan view of alternate drill components of an alternate drill system.
Figure 3B:
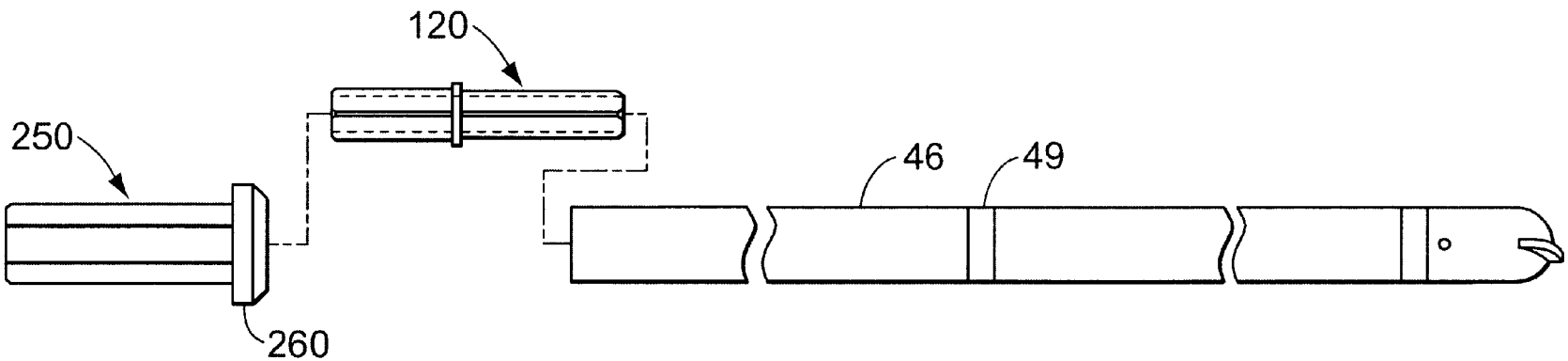
FIG. 3B is an exploded view of the drill components of FIG. 3A.

FIGS. 2A–2B illustrate, as an example, the drill members 46*a*, 46*b*, coupled together and coupled to the base 42, and the bit 56 via a bit seat 59. The drill members 46*a*, 46*b* (and also 46*c*, 46*d*, not in use yet in the configuration shown in FIGS. 2A–2B) each comprise an elongated bar having a round outside perimeter 112*c* and a hexagonal inside perimeter 112*d* defining a central through bore 112 and opposite open ends 112*a*, 112*b* (shown in FIGS. 4A, 4B).

The bit seat 59 includes a bit shank 59*a* and a base shank 59*b* each having polygonal, preferably hexagonal, outside perimeters. The drill bit 56 includes a socket 57 having a polygonal, preferably hexagonal, inside perimeter 57*a*. The bit shank 59*a* and a button clip 59*c* fit within the socket 57 and are used together to tightly engage the bit seat 59 to the bit 56 as explained in U.S. Pat. No. 6,189,632, herein incorporated by reference. The outside perimeter 59*b* of the bit seat shank 59*b* is shaped to snugly fit within the open end 112*a* of the drill member 46*a*. The seat 59 also includes a rounded flange 59*d* that matches the outside diameter of the drill member 46*a*.

Figure 4A:
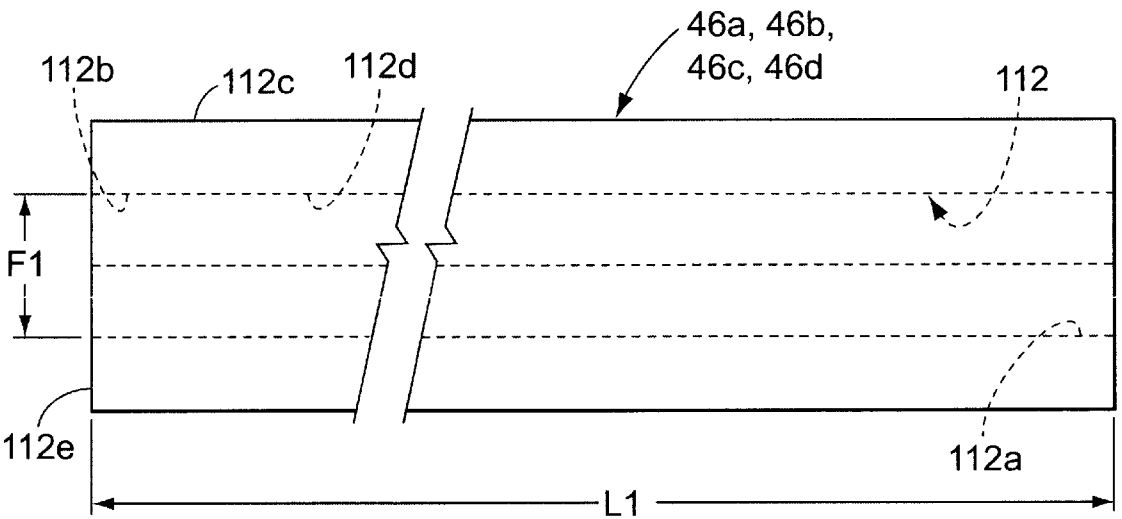
FIG. 4A is an enlarged plan view of a drill member of the drill components shown in FIGS. 2A–3B.
Figure 4B:
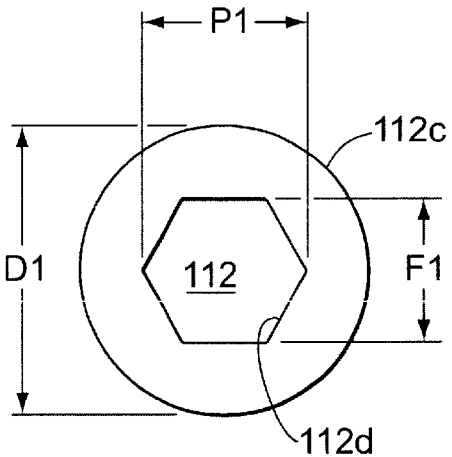
FIG. 4B is a side view of the drill member of FIG. 4A.

FIGS. 4A, 4B illustrate that the members 46*a*, 46*b*, 46*c*, 46*d* each has a cross section that defines the circular outside perimeter 112*c*, and the polygonal inside perimeter 112*d*, defining the through-bore 112. The polygonal inside perimeter allows for convenient coupling of the drill member 46*a* to the drill bit seat 59 at one end, and to the motorized drill driving device 34, or to a coupling 49, at an opposite end.

The drill members 46*a*–46*d* are preferably cut from stock available in length of 12 feet, although other lengths, such as 2 to 12 feet would also be useful. The drill members 46*a*–46*d* can be cut to any length, and the resultant cut open end can accommodate components without the need for machining a specialized coupling element or configuration. Additionally, the round outside perimeter 112*c* allows the drill member to be more quietly rotated within the drilled hole 47.

Returning to FIGS. 2A–2B, the base assembly 42 includes a stub member 120, and a base member 126. The base member 126 includes a bottom fixture 131 having a cross section defining a polygonal outside perimeter 131*a*. The polygonal outside perimeter 131*a* is provided by a square lug portion 170 shown in FIGS. 6A and 60 and described below. The outside perimeter 131*a* is sized to be received into a correspondingly shaped socket (not shown) of the motorized drill driving device 34 to couple the fixture 131 and the drill driving device 34 for mutual rotation. The base member 126 includes a collar 134 for receiving axial (upward) force from the drill driving device 34.

Figure 5B:
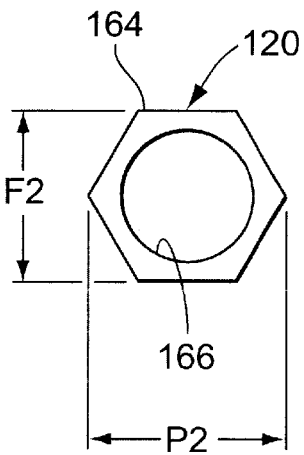
FIG. 5B is a side view of the stub member of FIG. 5A.
Figure 5A:
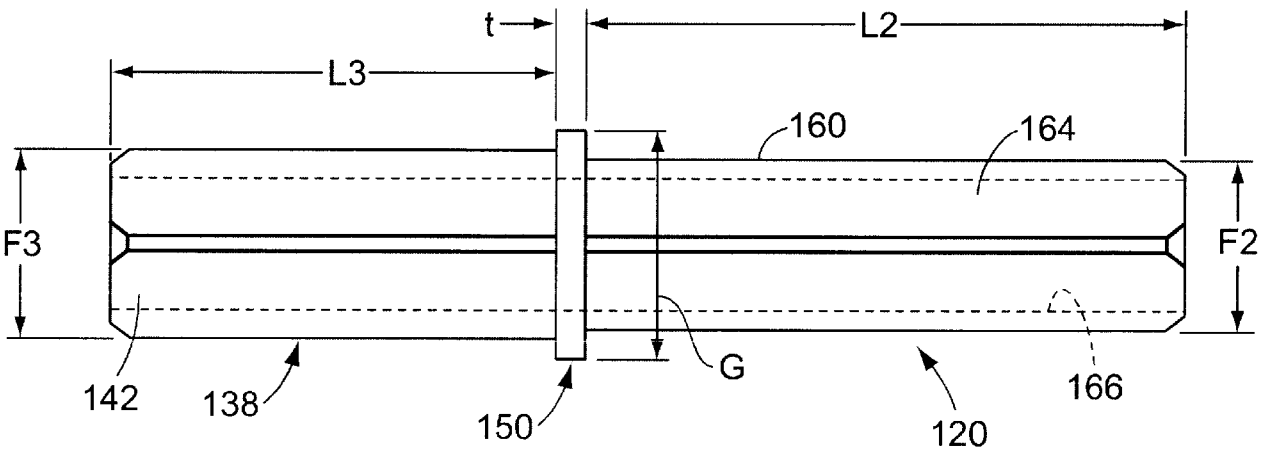
FIG. 5A is an enlarged plan view of a stub member of the drill components of FIGS. 2A–3B.
Figure 6B:
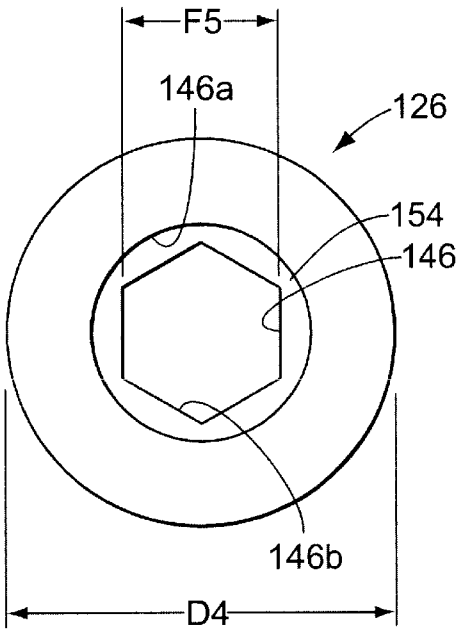
FIG. 6B is a right side view of the base member of FIG. 6A.
Figure 6A:
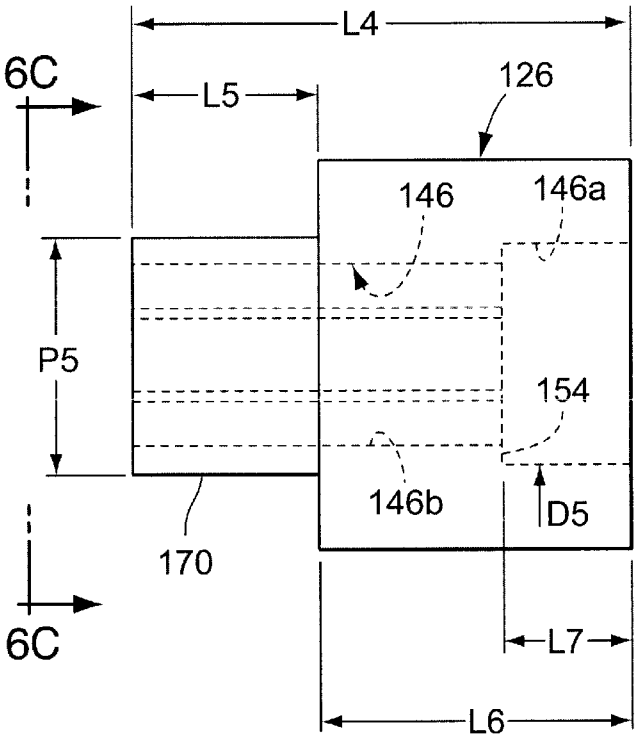
FIG. 6A is a plan view of a base member of the drill components shown in FIGS. 2A–2B.
Figure 6C:
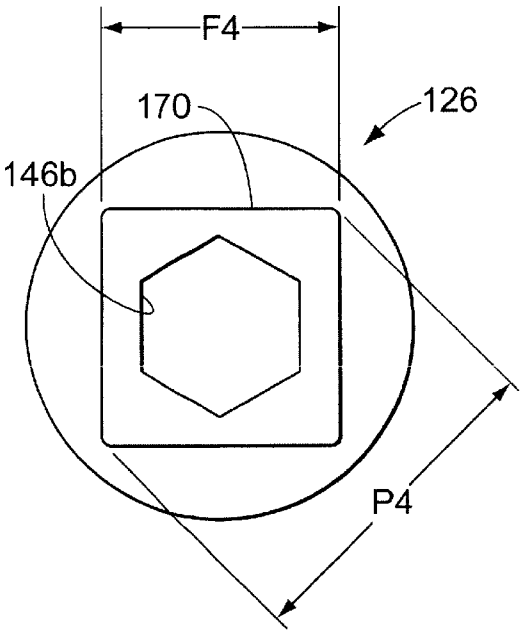
FIG. 6C is a left side view of the base member of FIG. 6A.
Figure 7:
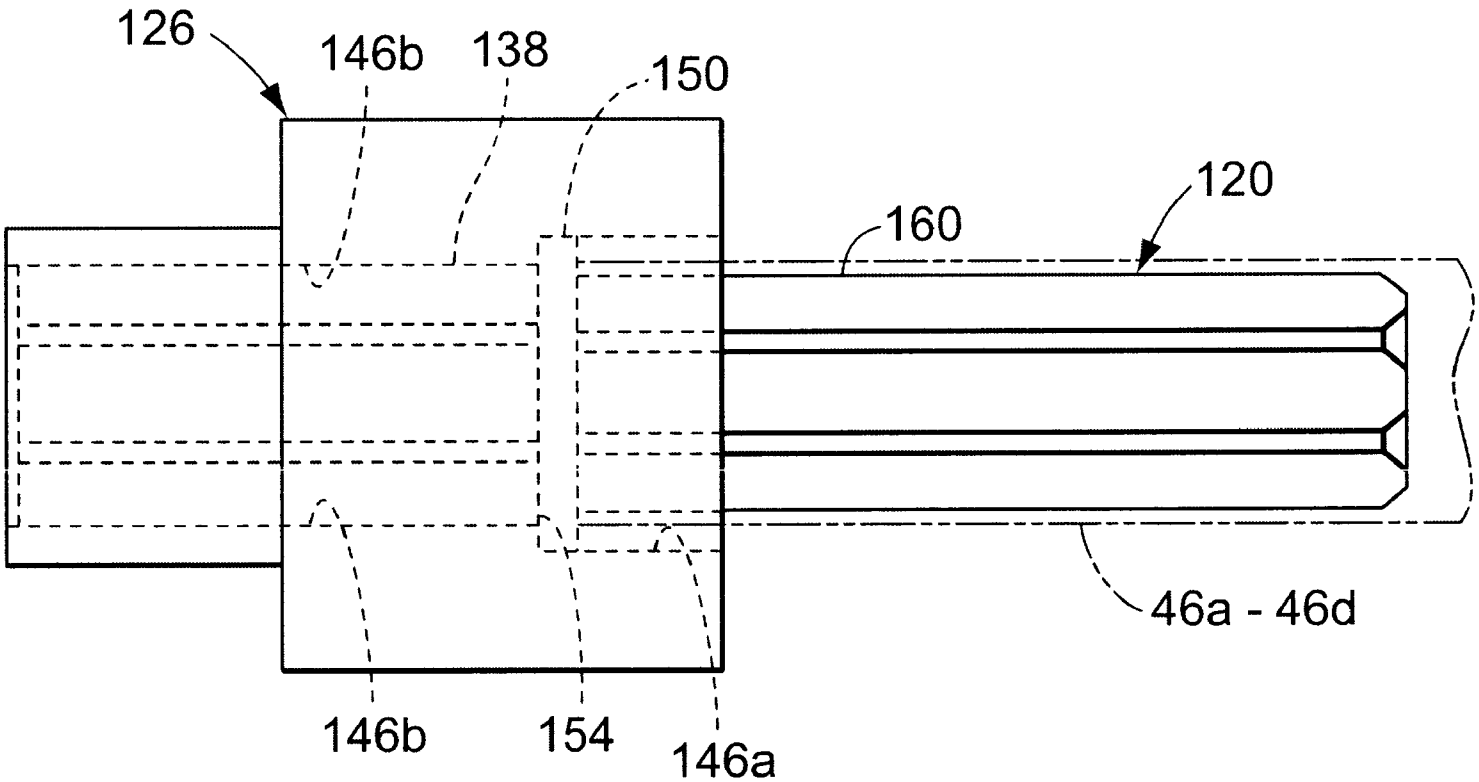
FIG. 7 is a plan view of the base member and stub member of FIGS. 2A–2B in an engaged configuration.
Figure 8B:
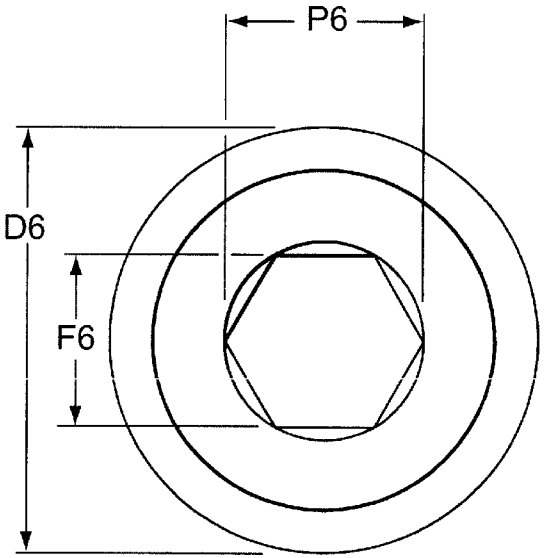
FIG. 8B is a right side view of the base member shown in FIG. 8A.
Figure 8A:
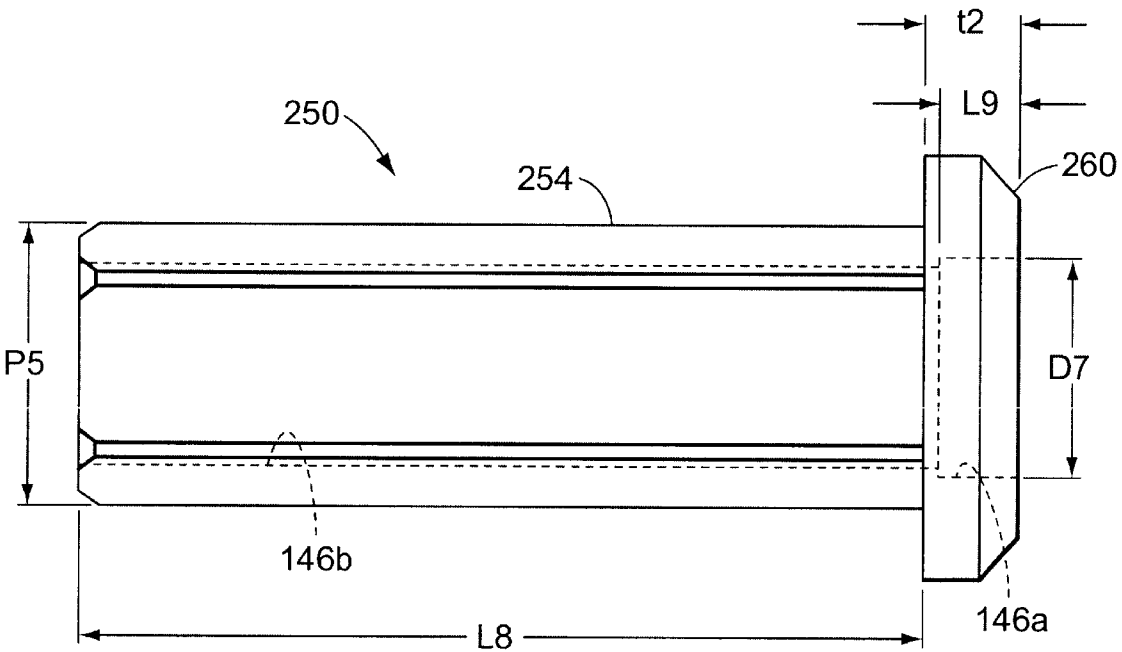
FIG. 8A is a plan view of the base member of the drill components shown in FIGS. 3A–3B.
Figure 9:
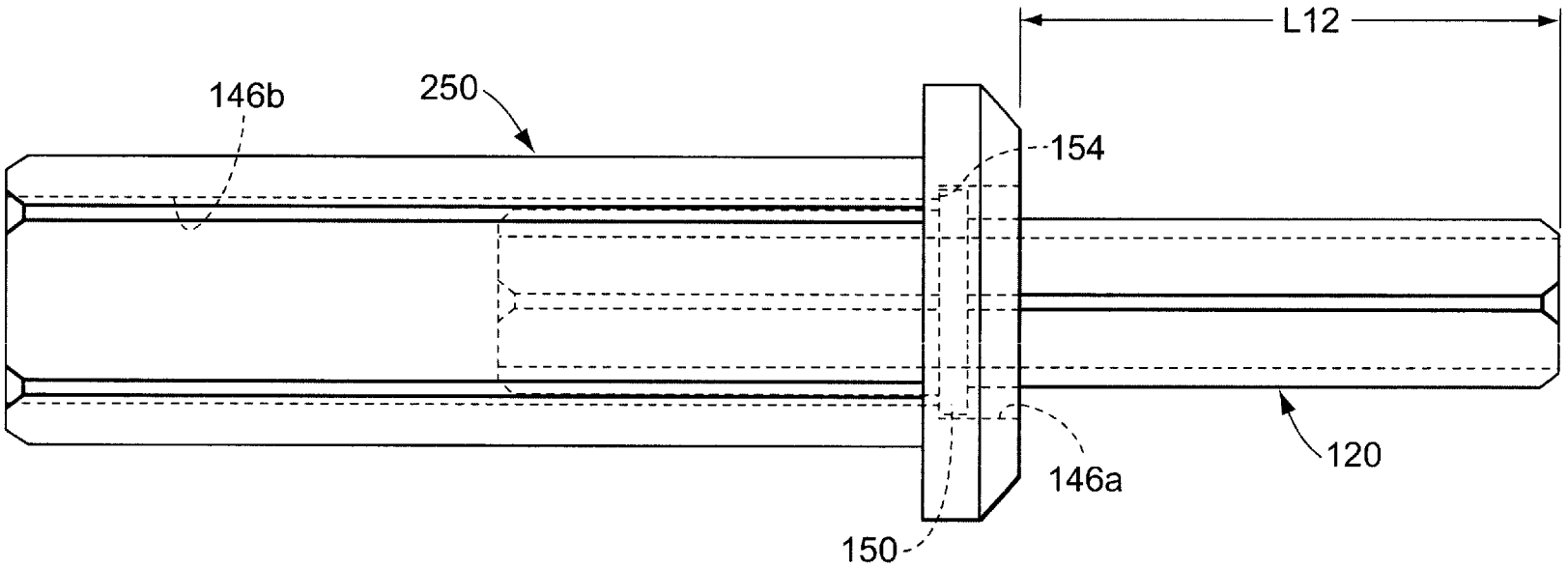
FIG. 9 is an enlarged plan view of the base member and the stub member of FIGS. 3A–3B in an engaged configuration.

FIGS. 5A–5B and 7 illustrate the stub member 120. The stub member 120 includes a bottom fixture 138 having a cross section defining a polygonal, preferably hexagonal, outside perimeter 142 that is received into a through bore 146, formed in the base member 126 (shown in FIGS. 6A and 6B). The stub member 120 further includes a flange 150 which rests on an internal shoulder 154 of the bore 146 in the base member 126 (FIGS. 6A and 6B). In this way, the axial force exerted on the base member 126 by the drill driving device 34 is transferred to the flange 150 of the stub member 120. The stub member 120 further includes a stub shaft 160 extending upwardly from the flange 150 and having a cross section defining an outside polygonal perimeter 164, sized and shaped to snugly fit within the open end 112*b* of the drill member 46*d*. The stub member 120 includes an axial through bore 166 (FIG. 5A) having a transverse circular inside perimeter, preferably being about 0.475 inches in diameter.

Referring to FIGS. 6A, 6B, and 7, the base member bore 146 includes a circular bore portion 146*a* and a polygonal bore portion 146*b*. The polygonal bore portion 146*b* is preferably hexagonal in transverse cross section. The polygonal bore portion 146*b* is sized to snugly receive the fixture 138 of the stub member 120 by press fitting the stub member 120 into the base member 126. The circular bore portion 146*a* is sized to receive the flange 150 onto the shoulder 154 and to allow a space surrounding the stub shaft 160 to receive an end portion of the respective lowest drill member 46*a*–46*b* (shown in phantom in FIG. 7) within the circular bore portion 146*a*. In this way, the axial force from the base member 126 to the flange 150 is transferred to an end face 112*e* of the drill member 46*a*-46*d*.

The base member 126 includes a square lug portion 170 for engagement by a corresponding socket, or chuck, of the drill driving device 34.

Figure 5C:
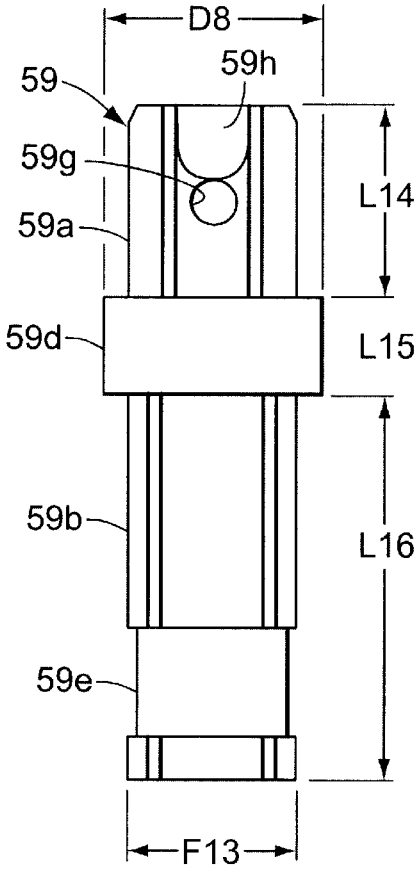
FIG. 5C is an elevational view of a bit seat.
Figure 5D:
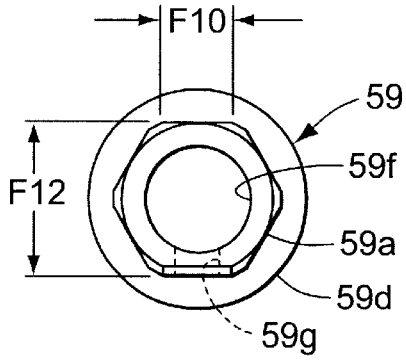
FIG. 5D is a top view of the bit seat of FIG. 5C.

FIGS. 5C and 5D illustrate the drill bit seat 59 according to the system of the invention. The seat includes the drill bit shank 59*a* and the base shank 59*b*. A recessed region 59*e* is provided in the shank 59*b* for receiving a safety ring as applicable. The seat includes the flange 59*d* having a preferred diameter D8. The shank 59*a*, 59*b* preferably have a hexagonal cross-section to be pressed into the socket 57 and the open end 112*a* of the drill member 46*a*, respectively. The seat has preferred dimensions L14, L15, L16. The seat includes a central through-bore 59*f*, a pin-receiving hole 59*g*, and a button clip flat 59*h*. The shank 59*a* has hexagon flat dimensions F10 and F12, as indicated. The shank 59*b* has hexagon flat dimension F13, as indicated. The connection of the drill bit to the bit seat is similar to that described in U.S. Pat. No. 6,189,632, herein incorporated by reference.

Figure 5E:
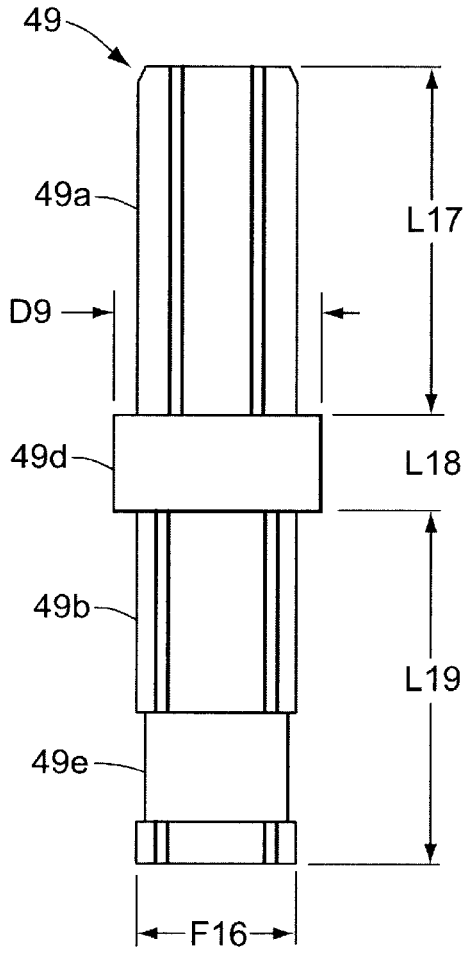
FIG. 5E is an elevational view of a coupling.
Figure 5F:
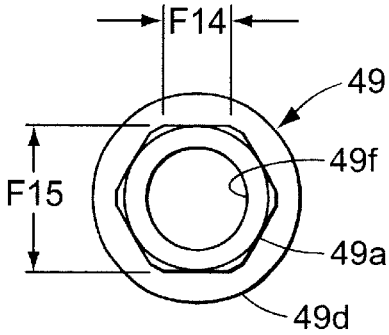
FIG. 5F is a top view of the coupling of FIG. 5E.

FIGS. 5E and 5F illustrate the coupling 49 according to the system of the invention. The coupling 49 includes a lead shank 49*a* and the base shank 49*b*. A recessed region 49*e* is provided in the base shank 49*b* for receiving a safety ring as applicable. The seat includes the flange 49*d* having a preferred diameter D9. The shanks 49*a*, 49*b* preferably have a hexagonal cross-section to be pressed into the open ends 112*a*, 112*b* of the drill member 46*a*, 46*b*, 46*c*, 46*d* respectively. The seat has preferred dimensions L17, L18, L19. The seat includes a central through-bore 49*f*. The shank 49*a* has hexagon flat dimensions F14 and F15, as indicated. The shank 49*b* has hexagon flat dimension F16 as indicated.

Referring to FIGS. 3A, 3B, 8A, 8B and 9, an alternate base assembly 242 is shown. The base assembly 242 includes an alternate base member 250 that comprises a fixture 254 having a polygonal transverse outside shape, and a collar 260. Preferably, the collar 260 is forged as a unitary part with the fixture 254. The alternate base member 250 has a longer fixture length L8 than the base member 126. The bore portions 146*a*, 146*b* are configured per the first embodiment, except for having different lengths.

Figure 10:
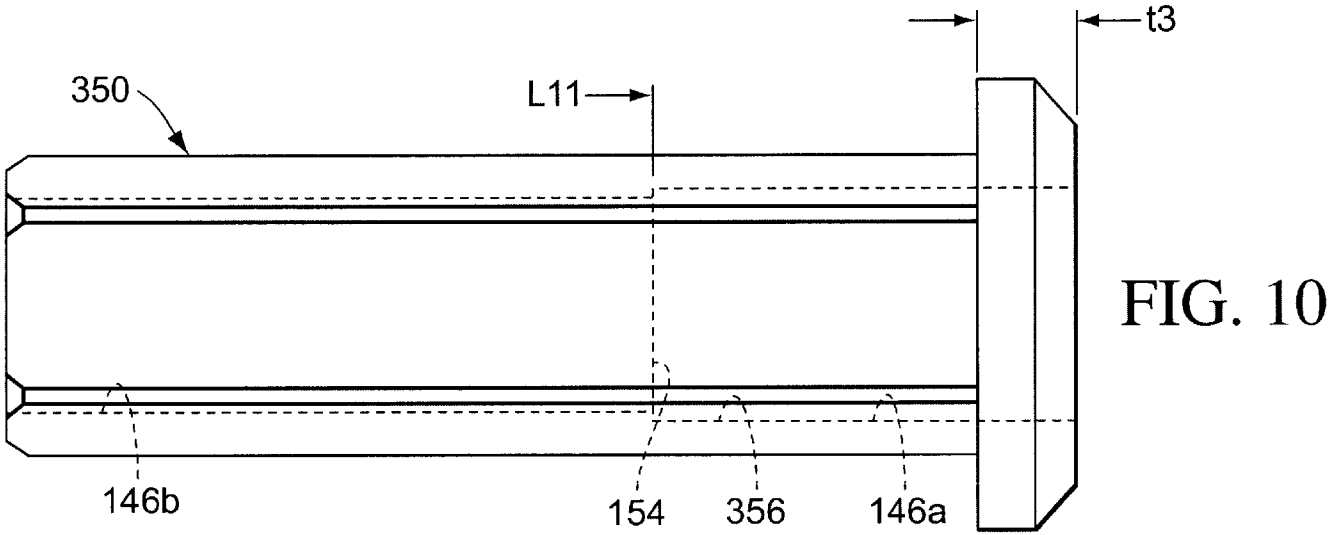
FIG. 10 is a plan view of an alternate base member.
Figure 11:
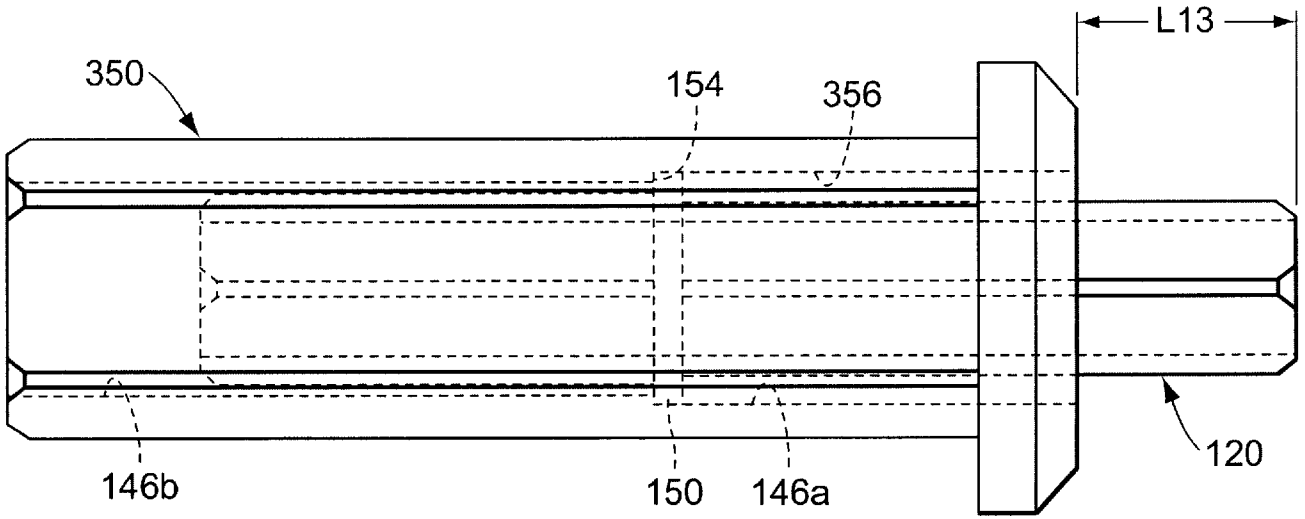
FIG. 11 is a plan view of the alternate base member and the stub member of FIGS. 10A–10B and FIGS. 5A–5B in an engaged configuration.

Referring to FIGS. 10 and 11, a second alternative base member 350 is shown. The second alternative base member 350 is similar to the base member 250 except for having a greater for depth L11 of the bore portion 146*a* of a through bore 356 for a deeper penetration of the stub member 120. The bore 356 has identical bore regions 146*a*, 146*b* as the bore 146, although elongated axially.

The drill members 46*a*–46*d* has the following preferred dimensions:

length L1=12 feet stock, cut to desired length diameter D1=0.95 inches polygon flat to flat width F1=0.63 inches polygon point to point width P1=0.70 inches The stub member 160 has the following preferred dimensions:

stub shaft length L2=2.50 inches flange thickness t1=0.05 inches fixture length L3=2.00 inches stub shaft polygon flat to flat width F2=0.615–0.62 inches stub shaft point to point width P2=0.675–0.68 inches fixture polygon flat to flat width F3=0.828 inches fixture polygon point to point width P3=0.91 inches The base 126 has the following preferred dimensions:

base member length L4=2.75 inches fixture length L5=0.86 inches hub length L6=1.89 inches hub diameter D4=1.75 inches fixture flat to flat width F4=1.112 inches fixture point to point width P4=1.46 inches bore flat to flat width F5=0.818 inches bore point to point width P5=0.93 inches bore opening diameter D5=0.96 inches bore countersunk depth L7=0.70 inches The alternate base member 250 has the following preferred dimensions:

length L8=3.875 inches thickness of collar t2=0.50 inches flat to flat width of fixture L10=1.120–1.125 inches point to point width of fixture P5=1.25 inches diameter of collar D6=1.75 inches flat to flat width of polygon bore F6=0.818 inches point to point width of polygon bore P6=0.96 inches bore opening diameter D7=0.96 inches bore countersunk depth L9=0.40 inches The second alternate base member 350 has the following preferred dimensions:

bore depth L11=1.50 inches

The extension of the stub shaft L12 out of the first alternate base member is 2.15 inches while the extension of the stub shaft L13 out of the second alternate base member is 0.55 inches.

The preferred dimensions for the bit seat and the coupling are as follows:

L14=0.8 in.

L15=0.39 inches

L16=1.5 in.

D8 0.94 inches diameter 59*f*=0.48 in.

F10=0.28 in.

F12=0.62 inches

F13=0.68 in.

L17=1.5 in.
L18=0.39 inches
L19=1.5 in.
diameter 49*f*=0.465 in.
F14=0.28 in.
F15=0.62 inches
F16=0.68 in.

The drill bit 56, the bit seat 59, the drill members 46*a*–46*d*, the stub member 120 and the base members 126, 250, 350 are all hollow and in air flow communication so that a suction applied to the base member will remove debris created by the action of the drill bit 56.

The preferred material of the drill members, the stub member, and the alternate base number is 4130. The preferred material of the base member is 4140H. The preferred material of the couplings and the bit seat is 4140.

A method of drilling bores for installing bolts in a mine roof is provided by the present invention. The inventive method includes the steps of:

providing a length of the hollow drill member stock, the drill member stock having the round outside perimeter 112*c* and the polygonal inside perimeter 112*d* and cutting the stock to a desired length to provide at least one individual drill member;

providing the drill bit 56 and a hollow bit seat 59, the bit seat having an arrangement for being fixed to the drill bit and the polygonal outside perimeter 59*b* sized and shaped to fit snugly within the open end 112*a* of the drill member 46*a*, to be coupled for rotation therewith;

providing the hollow stub member 120 coupled to a source of rotary power, the drill driving device 34, and having the polygonal outside perimeter 164 sized and shaped to fit snugly within the opposite open end 112*b* of the drill member 46*a*; and fitting one end of the drill member 46*a* onto the stub member 120;

fitting the bit seat 59 into the opposite end 112*a* of said drill member 46*a* and fitting the bit onto an opposite end of the seat 59; and rotating the stub member 120 and urging the drill member 46*a* upwardly.

The invention can comprise the further steps of: when the drill member 46*a* is sufficiently penetrated into the rock, removing the member 46*a* from the drill driving device and replacing the member 46*a* with a member comprising, in combination, the member 46*a* or similar, a coupling 49 and a second member 46*b*; or, leaving the member 46*a* in place in the hole 47 and adding the member 46*b* to it using a coupling 49, and then resume drilling.

The invention can comprise the further steps of: when the drill members 46*a* and 46*b* are sufficiently penetrated into the rock, removing the members 46*a*, 46*b* from the drill driving device and replacing the members 46*a*, 46*b* with a member comprising the member 46*a* or similar, the coupling 49, the member 46*b* or similar, another coupling 49 and a third member 46*c*; or, leaving the members 46*a*, 46*b* in place in the hole 47 and adding the member 46*c* to the member 46*b* using another coupling 49, and resume drilling.

The invention can comprise the further steps of: when the drill member 46*a*, 46*b*, 46*c* are sufficiently penetrated into the rock, removing the members 46*a*, 46*b*, 46*c* and replacing the members 46*a*, 46*b*, 46*c* with a combination comprising the members 46*a* or similar, 46*b* or similar, 46*c* or similar, and 46*d* with interposed couplings 49; or, leaving the members 46*a*, 46*b*, 46*c* in place in the hole 47 and adding the member 46*d* to the member 46*c* using another coupling 49, and resume drilling.

The inventive method is further characterized in that suction can be applied to the hollow stub member 120 to collect debris produced by the action of the drill bit 56.

The inventive method is further characterized in that when said drill bit progresses a predetermined distance, the drill member can be removed from the stub member and replaced with a longer drill member of identical cross section as the prior drill member, onto the stub member 120 and the bit fixture 57, and drilling is resumed.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A drilling system for drilling vertical holes in a mine roof, comprising:

a base assembly configured to be driven in rotation by a motorized drill driving device, said base assembly including a stub member, said stub member having an upper portion having a cross section defining a polygonal outside perimeter;

a drill member having an elongated hollow body having open ends, having a cross section defining a round outside perimeter and a constant polygonal inside perimeter along substantially the entire length of said drill member; and a drill bit having a base with a bit fixture extending rearwardly thereof, said bit fixture having a cross section with a polygonal outside perimeter; and said stub member and said bit fixture sized and shaped to fit snugly inside said open ends of said drill member.

2. The system according to claim 1, wherein said base assembly comprises a base member having a socket that is shaped for snugly receiving a lower portion of said stub member, said lower portion of said stub member having a cross section defining a polygonal outside perimeter, said base member having a contact surface for axially urging an end face of said drill member, said base member shaped to be engaged by a motorized drill driving device, said device axially urging said base member to exert an axial force on said drill member.

3. The system according to claim 2, wherein said contact surface comprises a shoulder on said base member, and said stub member comprises a flange for receiving said axial urging from said shoulder of said base member.

4. The system according to claim 2, wherein said base member comprises a collar for receiving an axial force from a drill driving device.

5. The drill member according to claim 1, wherein said drill member is between 2 feet and 12 feet long.

6. The drill member according to claim 1, wherein said polygonal inside perimeter has a hexagonal shape.

7. A drill member for use in a drilling system for installing roof bolts in a mine, comprising:

an elongated bar having a central through bore and opposite open ends, said bar having a constant transverse cross section along substantially the entire length thereof that defines a smooth circular outside perimeter and a polygonal inside perimeter.

8. The drill member according to claim 7, wherein said polygonal inside perimeter allows for coupling of the bar to drill bits at one end and to a motorized drill driving device at an opposite end.

9. The drill member according to claim 7, wherein said bar is between 2 feet and 12 feet long.

10. The drill member according to claim 7, wherein said polygonal inside perimeter has a hexagonal shape.

11. The drill member according to claim 7, wherein said bar is about 12 feet long.

12. A method of drilling bores for installing bolts in a mine roof, comprising the steps of:

providing a length of a hollow drill member, said drill member having a round outside perimeter and a polygonal inside perimeter that is constant throughout substantially the entire length of said hollow drill member;

providing a drill bit having a hollow bit fixture, said bit fixture having a polygonal outside perimeter sized and shaped to fit snugly within an open end of said drill member to be coupled for rotation therewith;

providing a hollow stub member coupled to a source of rotary power and having a polygonal outside perimeter sized and shaped to fit snugly within an opposite open end of said drill member; and fitting one end of said drill member onto said stub member;

fitting said bit fixture into an opposite end of said drill member; and rotating said stub member and urging said drill member upwardly.

13. The method according to claim 12, comprising the further step of applying suction to said hollow stub to collect debris produced by said drill bit.

14. The method according to claim 12 comprising the further step of, when said drill bit progresses a predetermined distance, removing said hollow drill member from said stub member and replacing said hollow drill member with a longer drill member of identical cross section as said hollow drill member, onto said stub member and bit fixture, and resuming drilling.

15. The method according to claim 12 comprising the further step of, when said drill bit progresses a predetermined distance, removing said hollow drill member from said stub member and, using a coupling, connecting a further drill member to the hollow drill member, said further drill member having an identical cross section as said hollow drill member, and connecting the further drill member to the stub member, and resuming drilling.

16. The method according to claim 12 wherein said step of providing a length of a hollow drill member is further defined by providing a piece of hollow drill member stock, said drill member stock having a round outside perimeter and a polygonal inside perimeter that is constant throughout a length of said hollow drill member stock, said drill member stock being greater than 2 foot in length; and cutting said hollow drill member stock to reduce its length to said length of said hollow drill member.

* * * * *